United States Patent [19]

Brown

[11] 4,237,626

[45] Dec. 9, 1980

[54] DEFORMABLE FOOT WEDGE

[76] Inventor: Dennis N. Brown, c/o Northwest Podiatric Laboratory Inc., 1091 Fir Ave., Blaine, Wash. 98230

[21] Appl. No.: 14,840

[22] Filed: Feb. 26, 1979

[51] Int. Cl.[3] ..... A43B 13/38; A43D 00/00

[52] U.S. Cl. ..... 36/43; 12/146 B

[58] Field of Search ..... 36/43, 44, 69, 95; 12/142 R, 146 B

[56] References Cited

U.S. PATENT DOCUMENTS

| | | | |
|---|---|---|---|
| 2,909,854 | 10/1959 | Edelstein | 36/43 |
| 3,161,970 | 12/1964 | Purtell | 36/43 |
| 4,015,347 | 4/1977 | Morishita et al. | 36/44 |
| 4,168,585 | 9/1979 | Gleichner | 36/95 |

*Primary Examiner*—Patrick D. Lawson

*Attorney, Agent, or Firm*—Blair, Brown & Kreten

[57] ABSTRACT

Disclosed herein is a moldable foot wedge which when suitably treated as by heat, becomes deformable so that the person for whom the wedge is to be customed fit is allowed to stand on the wedge thereby deforming same to conform identically to the contour of the person's foot, thereby filling voids. An area below the rear heel on one side thereof is defined as a plug which is not subjected to the heat treatment so that a beneficial cant of inclination can be provided to the wedge by not allowing this cold plug to be heat treated and thereby deformed. A method associated with the article is similarily disclosed.

7 Claims, 5 Drawing Figures

FIG. 4
REPLACE PLASTIC FOOT BED WITH HOT CORK LINER AND COLDPLUGS INTO BOOT
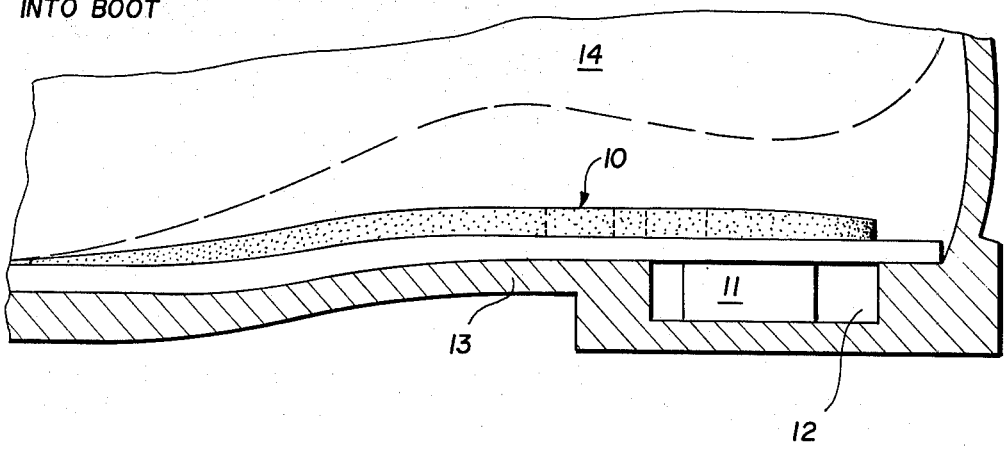
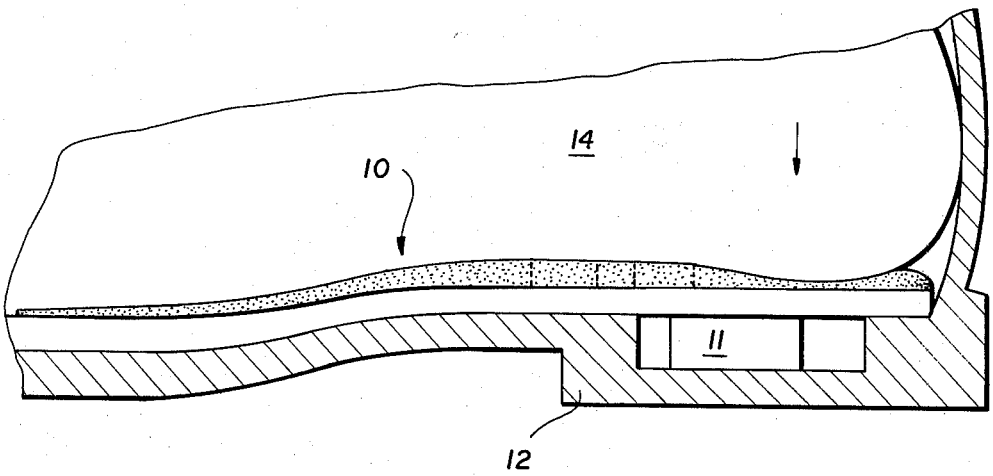
FIG. 5
INSERT FOOT IN BOOT KEEPING KNEES STRAIGHT AHEAD LET FULL WEIGHT REST ON HEEL

DEFORMABLE FOOT WEDGE

BACKGROUND OF THE INVENTION

The science and art of podiatry has long recognized the fact that if a foot is maintained in a balanced position, utilization of the foot will be correspondingly more efective since the foot's inter-relationship with other body parts can occur in an efficient manner.

Further, it is known that people suffering from varus or valgus can benefit from an orthotic device which encourages the foot to properly relate and address other body components such as the knee, ankle, etc.

Cooperation between these various body parts has long been recognized in skiing since improper relative orientation has been known to cause muscle fatigue, cramps, as well as increase the likelihood of stranded ligaments. This is especially true in skiing since effective edge control of the ski is predicated upon a sensitivity that begins with the feet and is translated to the upper body portions. Obviously, similar endeavors such as jogging, and even common pedestrian activities can benefit from an orthotic device which causes the foot to properly address its associated terrain.

The following U.S. patents represent the state of the art of which the inventor is aware along with distinctions over that which define the invention according to the present application.

Schwartz 973,077
Jones 1,675,711
Bubner 2,794,270
Scholl 3,244,177
Dubner 3,903,621

The patent to Scholl teaches the use of a shoe inlay comprising cork and resin in a plasticisen having a leaf spring disposed within the inlay. Heating the inlay allows deformation. The patent of Jones teaches punching out slugs in the front and rear portions of a shoe so as to provide a nesting surface for a cushion.

It is apparent that none of these references provides the composit benefits attendant with the apparatus associated with the instant application since the use of the plug portion of the instant application provides a camber or wedge type adjustment not contemplated by the prior art in combination with a deformable shoe or boot insert which when deformed by the user, serves to fill voids between the boot and the user's foot so as to provide support, resilience, a correction for varus or valgus, a closer interaction between the boot (shoe) and the occupant, and the like.

SUMMARY OF THE INVENTION

Accordingly, an object of this invention embraces the desire to provide an orthotic device which corrects for varus or valgus while simultaneously providing an insert which is permanently deformable to accomodate and adapt to feet having different configurations.

A further object has as an objective deforming the orthotic device according to the present application in such a manner that the vertical relationship between the knee and its associated foot can be controlled and corrected.

A further object includes providing an orthotic device which diminishes the amount of play between a boot of shoe and its associated foot thereby encouraging a greater sensitivity or feel between the two.

These and other objects are made possible by providing an orthotic device in which a portion of same is capable of deformation, while plugs or inserts are incapable of deformation to provide the necessary angulation of the heel portion of a foot, and simultaneously molding the orthotic device when the knee is correctly oriented relative to the foot so that this beneficial alignment becomes permanent.

These and other objects will be made manifest when considering the following detailed specification and drawings.

BRIEF DESCRIPTION OF THE DRAWINGS

FIG. 3 is a perspective view of the orthotic device when placed on a boot bed for use in a ski boot;

FIG. 4 is a sectional view of the device when placed within a ski boot or similar object; and FIG. 5 shows the deformation that occurs when the foot is placed thereagainst.

DESCRIPTION OF THE PREFERRED EMBODIMENT

Figure 1:
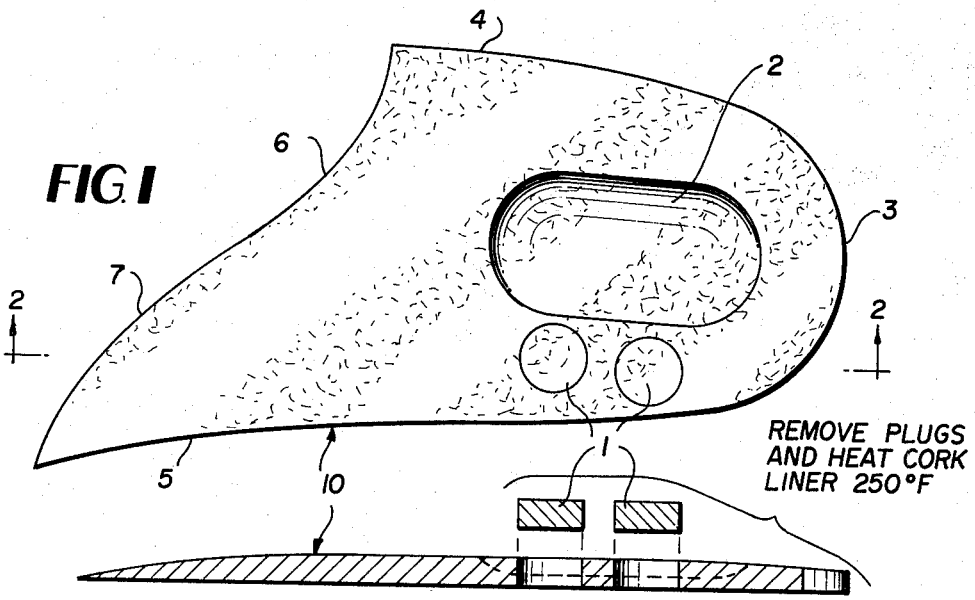
FIG. 1 details a top plan view of the orthotic device according to the present invention.
Figure 2:
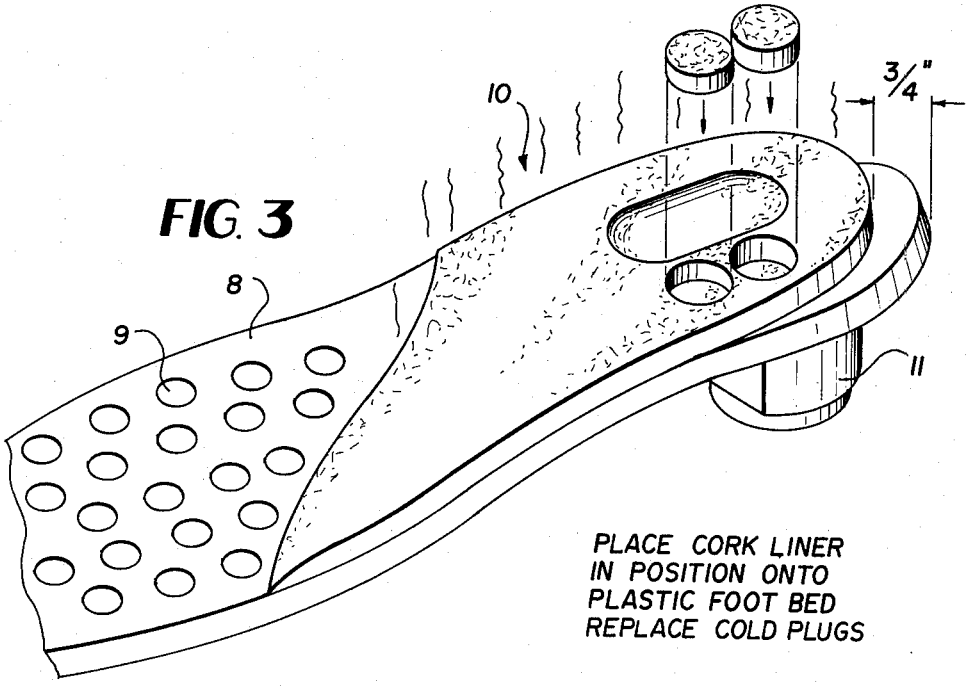
FIG. 2 is a sectional view taken along lines 2—2 of FIG. 1.

Referring to the drawings now, wherein like reference numerals refer to like parts throughout the several drawings, reference numeral 10 is directed to the orthotic device according to the present invention. The orthotic device 10 as shown in the drawings defines an insert for use with shoes or boots which in the preferred form covers the rear half of the shoe near the heel, and has a portion extending into the arch area.

Directly below the calcaneus or heel area of the foot, there is a slight indentation 2 which tends to conform to the natural contour of the heel. Proximate thereto on the arch side of the foot are a pair of plugs, or a single plug of any desired shape such as a kidney shape which have been pre-punched so that they are easily removable from the orthotic device by merely pushing.

The orthotic device 10 is preferrably made from a cork and resin composition which when heated swells to almost twice its original volume. It is preferred that the orthotic device 10 when the plugs 1 have been removed therefrom be heated at 200 to 250 degrees F. for about 2 to 3 minutes to obtain this beneficial swelling. The plugs 1 are not heated so they therefore will not shrink or expand nor be deformable even though they are made of the same material as the rest of the orthotic device. The purpose of maintaining these plugs in a cold condition is to allow the proper foot angulation to correct for bowlegged or knock-kneed afflictions by providing the appropriate inclination, and these plugs normally will provide a 4 or 5 degree angulation as is required.

It is to be noted that when the foot is not balanced and is in a neutral position, the knee cap does not point downwardly towards the outside of the foot substantially over the fifth or small toe. Excessive pronation of the foot causes the knee to point towards the inside or arched side of the foot thereby causing the foot to be unbalanced, making the ball of the foot more pronounced and more vulnerable to bruising.

The device 10 has a curved terminal portion 3 complimental to the terminus of one's heel, and the opposed sides of the device diverge outwardly along the top side and bottom side 5 as shown in FIG. 1. It is to be noted that the bottom side 5 has a greater longitudinal extent, and in fact terminates just before the ball of the foot underneath the arch. The top portion or outer edge of outer edge of the device terminates substantially where the arch intersects the outer portion of the foot, and two areas are interjoined by means of a curved end opposite from the heel having a complex curvature which firsts curves inwardly toward the heel and than outwardly towards the ball of the foot terminating substantially in a point.

For the specific example illustrated, the ensuing description will detail the use of the device 10 in a ski boot and a foot bed associated therewith, but it should be evident that this device is equally adaptable for other types of shoes.

With the orthotic device 10 having been heated at 250 degrees for 2 of 3 minutes so that it has approximately doubled its original volume by swelling, the device 10 is placed on top of the foot bed three quarters of an inch from the rear portion of the foot bed, and substantially flush with this side of the foot bed supporting the arch. If the foot bed is provided with a plurality of openings 9 they should be sealed with silver tape for example so as to discourage the migration of any of the cork and resin therein. The foot bed 8 and the associated orthotic device 10 is allowed to engage the foot 14 of a person in such a manner that the heel of the foot touches down on the device only after the toes have been substantially advanced to the front of the boot. For best results, the foot which is to be treated is placed approximately 2 inches in front of the toe of the other foot, so that the heel of the foot to be fitted is in front of the toe of the other foot, by this margin, and the weight is applied from the heel of the boot forwardly lightly until the leading foot that is being treated is flush on the ground. Thereafter, the hips are rotated in the direction of the forward boot so that the knee rotates outward and points over the fifth or small toe so that the correct vertical alignment has been assured, and gradually the shift of weight is brought about on to the forward boot so that the weight is balanced over the outside edge of the boot's sole. After about 10 seconds, most of the body weight may be applied to the forward boot, keeping the knee rotated outwardly and with the weight centered over the outside edge of the boot for about ½ a minute. This allows the orthotic device 10 to assume the contour of the foot in its most beneficial orientation, and it is at this point that the weight may be removed from the foot, but the device be allowed to remain in registry with the foot for about 15 minutes to allow enough time for the cork to cool and set. When the procedure is completed, and the hips are relaxed thereby allowing the knee cap to assume its original configuration, the final alignment should have the knee cap pointing down over the second toe. The initial alignment is used to prevent excessive compression of the orthotic device during the molding period.

It should be apparent therefore that since the plugs used therein have not been heat treated, they will not be subject to the deformation and therefore will provide the beneficial angulation that is desire. The cold plugs are inserted before molding and after heating. Further, it should be appreciated that although the ski boot has been illustrated in which an outer shell 13 of the ski boot is provided with an opening 12 above the heel within which a depending portion 11 of the foot bed expands, this orthotic inlay is suitable for insertion into a plurality of different kinds of shoes.

By way of comparison, the prior art devices of which this applicant is aware includes foam arch supports and the like in which the softness of these devices collapse and compress under the foot during stearing which translates directly into pronation. Further, the foam often feels lumpy under foot muscle tissues, and invariably causes extreme cramps. A further important distinction over a foam impression casting method is that in the casting method, the whole foot adapts to the pressures being applied to the foot, whereas in the instant device, the insert is deformed by the forces the foot applies thereon, and when properly supervised, assures correct orientation of the knee relative to the toes. Further, the device according to the present invention helps fill medial arch voids, and add support along and under the medial aspect of the foot. It also helps align the subtaler joint more in a neutral position. This tends to result in greater balance, edge control and steering response in sking as well as a greater sensitivity of feeling the edges of your skis since there is a minimal amount of play between your feet and the boots.

Further, it should be apparent that by changing the internal shape of the shoe, the foot bed has thereby been customized to correspond exactly to the configuration of the user as well as provide a beneficial realignment of the foot so that same properly supports the rest of the body. In addition, the dimension of the plugs may have various configuration and depths corresponding to the degrees of angulation desired in canting the foot. While it has been demonstrated hereinabove that this device can be beneficially placed on the underside of the foot to provide a contour therefore, the device can (if suitably fashioned) be placed on the top face of the foot below the tongue of the boot so as to provide a similar customed contour thereon.

Having thus described the invention, it should be apparent that numerous structural modifications are contemplated as being a part of this invention as set forth hereinabove and as defined hereinbelow by the claims.

What is claimed is:

1. An orthotic device for use between a foot and a shoe or a boot preferrably made from cork and resin comprising an insert which when heated expands twice the original volume, and plug means removable from said insert and not to be heated whereby when said plug means are reinserted into the heated orthotic device, the orthotic device deforms by foot pressure, but the plug means retain their original dimension.

2. The device of claim 1 wherein said insert is provided with an indentation below the heel.

3. The device of claim 2 in which said plug means are disposed along side the indentation on the side of the insert proximate to the arch.

4. A method for custom fitting an insert within a shoe or a boot comprising the steps of removing plug elements, heating the insert until said insert expands, reinserting the unheated plugs back into said insert, placing said insert into a boot so that there is substantially a gap of three quarters of an inch between the back edge of the boot and the heel terminus of the insert, inserting the foot into the boot, advancing the booted foot approximately two inches in front of the toe of the other foot that has not been fitted yet, applying pressure on the heel of the foot and thereafter the entire foot that is being fitted at approximately 10 percent of the entire weight of the person, rotating the hip and the knee of that boot so that the knee cap points downwardly over the small toe, applying the full weight thereon.

5. The method of claim 4 further including the step of leaning the full weight thereon for substantially 2 or 3 minutes, and thereafter keeping the boot on for at least 15 minutes to allow the insert to cure and harden.

6. The method of claim 5 including heating the insert at 250 degrees for 2 or 3 minutes.

7. The method of claim 6 including providing the plugs with a plurality of different dimensions so as to provide different degrees of inclination.

* * * * *